US012022867B2

(12) United States Patent
Wang et al.

(10) Patent No.: US 12,022,867 B2
(45) Date of Patent: Jul. 2, 2024

(54) ELECTRONIC CIGARETTE

(71) Applicants: SHANGHAI NEW TOBACCO PRODUCT RESEARCH INSTITUTE CO., LTD, Shanghai (CN); SHANGHAI TOBACCO GROUP CO., LTD, Shanghai (CN)

(72) Inventors: Jiajun Wang, Shanghai (CN); Chao Chen, Shanghai (CN); Jijun Cai, Shanghai (CN); Zhenming Tong, Shanghai (CN)

(73) Assignees: SHANGHAI NEW TOBACCO PRODUCT RESEARCH INSTITUTE CO., LTD (CN); SHANGHAI TOBACCO GROUP CO., LTD (CN)

( * ) Notice: Subject to any disclaimer, the term of this patent is extended or adjusted under 35 U.S.C. 154(b) by 997 days.

(21) Appl. No.: 16/962,567

(22) PCT Filed: Jun. 4, 2018

(86) PCT No.: PCT/CN2018/089815
§ 371 (c)(1),
(2) Date: Jul. 16, 2020

(87) PCT Pub. No.: WO2019/140852
PCT Pub. Date: Jul. 25, 2019

(65) Prior Publication Data

US 2020/0397048 A1 Dec. 24, 2020

(30) Foreign Application Priority Data

Jan. 16, 2018 (CN) ..... 201820071279.6

(51) Int. Cl.
*A24F 40/40* (2020.01)
*A24F 40/51* (2020.01)
(Continued)

(52) U.S. Cl.
CPC ..... *A24F 40/40* (2020.01); *A24F 40/51* (2020.01); *A24F 40/10* (2020.01); *A24F 40/50* (2020.01)

(58) Field of Classification Search
None
See application file for complete search history.

(56) References Cited

U.S. PATENT DOCUMENTS

2011/0036346 A1 2/2011 Cohen et al.
2013/0228190 A1* 9/2013 Weiss ..... A24F 13/14 131/331
(Continued)

FOREIGN PATENT DOCUMENTS

CN 203618780 U 6/2014
CN 203644841 U 6/2014
(Continued)

OTHER PUBLICATIONS

English translation of Xiu (KR 20120053521A) (Year: 2012).*
(Continued)

*Primary Examiner* — Katherine A Will
(74) *Attorney, Agent, or Firm* — John Maldjian, Esq.; Stevens & Lee PC

(57) ABSTRACT

Embodiments of the invention relates to an electronic cigarette, comprising a cigarette cartridge; a cigarette rod, which is connected to the cigarette cartridge and which is used to supply electricity to the cigarette cartridge; a decorative part, wherein there is at least one decorative part arranged along the periphery direction partially or fully encircling the cigarette rod. The decorative part of the electronic cigarette is arranged encircling the cigarette rod of the electronic cigarette. When the electronic cigarette slips and falls onto the ground, the decorative part will touch the ground first, providing a cushioning and shock-absorbing effect, thereby
(Continued)

protecting the cigarette rod such that inner elements of the cigarette rod may work normally.

18 Claims, 4 Drawing Sheets

(51) Int. Cl.
*A24F 40/10* (2020.01)
*A24F 40/50* (2020.01)

(56) References Cited

U.S. PATENT DOCUMENTS

| | | | | |
|---|---|---|---|---|
| 2016/0213062 | A1* | 7/2016 | Doyle | A45F 5/02 |
| 2017/0127724 | A1* | 5/2017 | Liu | A24F 40/60 |
| 2018/0220706 | A1* | 8/2018 | Furin | A24F 40/40 |

FOREIGN PATENT DOCUMENTS

| | | | |
|---|---|---|---|
| CN | 204120239 | U | 1/2015 |
| CN | 204362967 | U | 6/2015 |
| CN | 104839894 | A | 8/2015 |
| CN | 105011378 | A | 11/2015 |
| CN | 204888731 | U | 12/2015 |
| KR | 20120053521 | A | 5/2012 |

OTHER PUBLICATIONS

English translation of International Search Report issued in connection with the corresponding International Application No. PCT/CN2018/089815 (2 pages total).
Communication Under Rule 71(3) EPC mail Oct. 20, 2022 issued in connection with corresponding EP Application No. 19865271 (25 page total).
Extended European Search Report mail Mar. 26, 2021 issued in connection with corresponding EP Application No. 18900677.8 (7 pages total).
Notice of Allowance mail Mar. 11, 2022 issued in connection with corresponding JP Application No. 2020-538817 and English language translation (6 pages total).
Notice of Allowance mail May 2, 2023 issued in connection with corresponding KR Application No. 2020-7022438 and English language translation (4 pages total).
Office Action mail Aug. 10, 2021 issued in connection with corresponding JP Application No. 2020-538817 and English language translation (9 pages total).
Office Action mail Aug. 27, 2022 issued in connection with corresponding KR Application No. 2020-7022438 and English language translation (9 pages total).

* cited by examiner

ELECTRONIC CIGARETTE

CROSS REFERENCE TO RELATED APPLICATIONS

This application claims the benefit under 35 U.S. C. § 371 of International Application No. PCT/CN2018/089815 filed on Jun. 4, 2018, which in turn claims the benefit of Chinese Application No. 201820071279.6 filed on Jan. 16, 2018, the entire content of each of which is hereby incorporated by reference in its entirety.

TECHNICAL FIELD

Embodiments of the invention relate to an electronic cigarette.

BACKGROUND

Traditional cigarettes are harmful to people's health, and electronic cigarettes came into being as a substitute. For example, Chinese patent publication CN204888731U discloses an electronic cigarette comprising cigarette rod and cigarette cartridge, wherein the cigarette rod includes: a battery and a controller connected to the battery; the cigarette cartridge includes: an aerosol generator and a unit for providing identifying information connected to the aerosol generator, wherein the unit for providing identifying information sends identifying information to the controller, and the controller determine whether the cigarette rod matches the cigarette cartridge based on the identifying information received. If they match, the aerosol generator is allowed to work normally, and if they do not match, the controller performs an alarm or prohibits the aerosol generator from working normally.

Chinese patent publication CN105011378A discloses an electronic cigarette, intelligent management system and method thereof, wherein the electronic cigarette includes a cigarette rod and a cigarette cartridge that matches with the cigarette rod and contains e-liquids; the cigarette rod is provided inside with an aerosol generator for atomizing the e-liquids; the cigarette cartridge is provided inside with electronic tag for identifying e-liquids identification code; the cigarette rod is further provided inside with an user authentication module, a NFC chip and a control unit, wherein the user authentication module is provided with user authentication code, and the NFC chip reads the electronic tag; the control unit turn on or shuts down the aerosol generator when the e-liquids identification code read by the NFC chip matches the user identity verification code or not.

Chinese patent publication CN203618780U discloses an electronic cigarette with a mouthpiece having a dustproof function, which includes a mouthpiece, a cigarette butt, a cigarette rod, a battery, an aerosol generator, a switch and a cigarette cartridge, wherein one end of the cigarette rod is connected to the mouthpiece, and the other is connected to the cigarette butt; the battery is provided at the end of the cigarette rod adjacent to the cigarette butt; the cigarette cartridge is provided at the end of the cigarette rod adjacent to the mouthpiece; the aerosol generator is provided inside the cigarette rod and between the battery and the cigarette cartridge; the end of the cigarette rod adjacent to the mouthpiece is provided with a sliding sleeve, and one end of the sliding sleeve is in contact with the switch.

In the prior art, an electronic cigarette generally includes a cigarette cartridge and a cigarette rod. The electronic cigarette has a smoking function only, a single appearance and no added value, leading to a poor user experience. In addition, when users smoke with the electronic cigarette, the electronic cigarette tends to slip out easily due to carelessness. Once the electronic cigarette falls out, internal components could not operate as normal because of the cigarette rod being vibrated.

DISCLOSURE

In order to solve the above mentioned problems, an embodiment of the invention is to provide an electronic cigarette comprising: a cigarette cartridge, a cigarette rod, which is connected to the cigarette cartridge and provides electricity to the cigarette cartridge, and at least one decorative part partially or fully encircling the cigarette rod along the circumferential direction.

Further, the decorative part includes a first part and at least one second part, wherein the first part sleeves the cigarette rod, and said at least one second part is connected with the first part, and partially or fully encircles the cigarette rod along the circumferential direction.

Further, the first part and the second part are formed in integrity.

Further, the first part is clamped with the cigarette rod, and the second part is clamped with the first part.

Further, at least one second part is provided with a light source, and the second part is electrically connected to the first part that is electrically connected to the cigarette rod.

Further, the cigarette rod is provided with a power supply and a power switch that triggers the electrical connection between the power supply and the first part.

Further, the cigarette rod is provided inside with a power supply and a gas path sensor, wherein the gas path sensor controls the power supply to provide electricity to the cigarette cartridge when detecting that the aerosol channel in the cigarette cartridge is in a circulating state, and the power supply and the first part are electrically connected.

Further, the cigarette rod is further provided with cigarette rod printed circuit board (PCB), on which the power supply is provided, wherein the portion of the cigarette rod facing the first part is provided with through holes for exposing the positive contact and the negative contact on the cigarette rod PCB; the first part is provided with positive pin and negative pin that are respectively inserted into each through hole to achieve an electrical connection with the cigarette rod PCB.

Further, the positive pin and the negative pin are provided on the inner cavity wall of the first part, and can move toward or away from the inner cavity wall in a radial direction that is perpendicular to the direction of the extension of the cigarette rod.

Further, the positive pin and the negative pin are arranged oppositely along the radial direction.

Further, at least two second parts that are spaced equally along the circumferential direction.

Further, the extending direction of the second part is set at an angle with the extending direction of the cigarette rod.

Further, the second part and the first part are rotatably connected; the second part rotates with respect to the first part when subjected to an external force so said angle changes, and stand still with respect to the first part without external force.

Further, the angle ranges from 0 degree to 180 degrees.

Further, the second part is rotatably connected to the first part through a rotating shaft, and the axial direction of the rotating shaft is orthogonal to the extending direction of the cigarette rod.

Further, the rotating shaft is a damping shaft.

Further, the second part is in a shape of a straight bar or a curve.

Further, the cigarette rod is longer than the second part, or the second part is longer than the cigarette rod in the direction from the cigarette cartridge toward the cigarette rod.

Further, the portion of at least one of the second part facing the cigarette rod is a concave portion which extends along the extending direction of the second part.

Further, the first part is provided with at least one convex portion on its outer surface, the convex portion having a perforation or being in a hook shape.

Further, the convex portion is arc-shaped.

Further, the decorative part is detachably connected with the cigarette rod.

As mentioned above, an embodiment of the electronic cigarette invention has a cigarette cartridge and a cigarette rod connected with each other, and the cigarette rod supplies power to the cigarette cartridge for users to smoke. The electronic cigarette further includes at least one decorative part partially or fully encircling the cigarette rod along the circumferential direction. The decorative part makes the electronic cigarette with no longer single appearance but adds decorative effect, bringing users with good experience. At the same time, when the electronic cigarette slides off to the ground, the decorative part encircling the cigarette rod will first make contact with the ground so as to play a role of buffering and damping, thereby protecting the cigarette rod and ensuring the internal components of the cigarette rod to work as normal.

In order to make the above contents understandable, embodiments are described in detail below in conjunction with the drawings.

DETAILED DESCRIPTION

The following specific embodiment describes the implementation of embodiments of the invention, and those skilled in the art can easily understand other advantages and effects from the content disclosed herein. Although the description of embodiments of the invention is introduced, this does not mean the features invention are limited to these embodiments. On the contrary, the purpose of introducing the invention in combination with the embodiments is to cover other options or modifications that may be extended based on the claims of the invention. In order to provide a deep understanding of the invention, the following description will contain many specific details. The invention can also be implemented without these details. In addition, in order to avoid confusing or obscuring the focus of the invention, some specific details will be omitted in the description.

Figure 1:
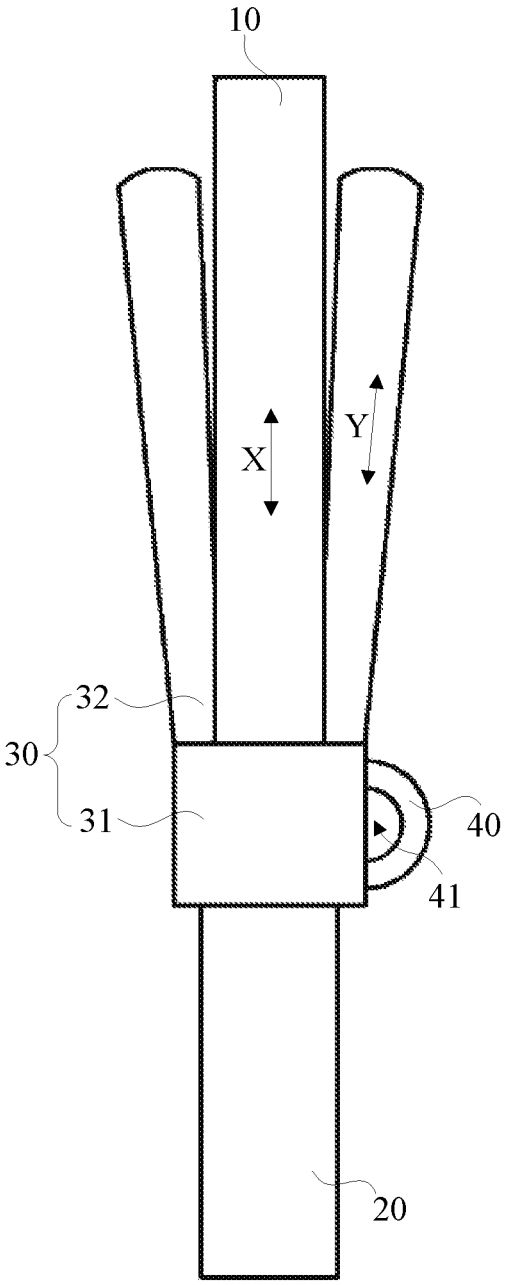
FIG. 1 is a side view 1 of the electronic cigarette according to an embodiment of the invention.

Referring to FIG. 1, an embodiment of the invention provides an electronic cigarette comprising a cigarette cartridge 20, which contains cigarette liquid. The cigarette cartridge 20 can be a disposable cartridge, or a non-disposable cartridge that can be refilled. The cigarette cartridge 20 is connected to a cigarette rod 10 in which is provided with a power supply (not shown in figures) that provides electricity to an aerosolization component (not shown in figures) in the cigarette cartridge 20, and after the aerosolization component is powered on, it atomizes the cigarette liquid to generate aerosol for users to suck. The electronic cigarette of the present invention further includes at least one decorative part 30 partially or fully encircling the cigarette rod 10 along the circumferential direction. The decorative part 30 makes the electronic cigarette with no longer single appearance but adds decorative effect, bringing users with good experience. At the same time, when the electronic cigarette slides off to the ground, the decorative part 30 encircling the cigarette rod will first make contact with the ground so as to play a role of buffering and damping, thereby protecting the cigarette rod 10 and ensuring the internal components of the cigarette rod 10 to work as normal.

It should be noted that the decorative part 30 is detachably connected with the cigarette rod 10. In other embodiments, the decorative part is fixedly connected with the cigarette rod.

Figure 2:
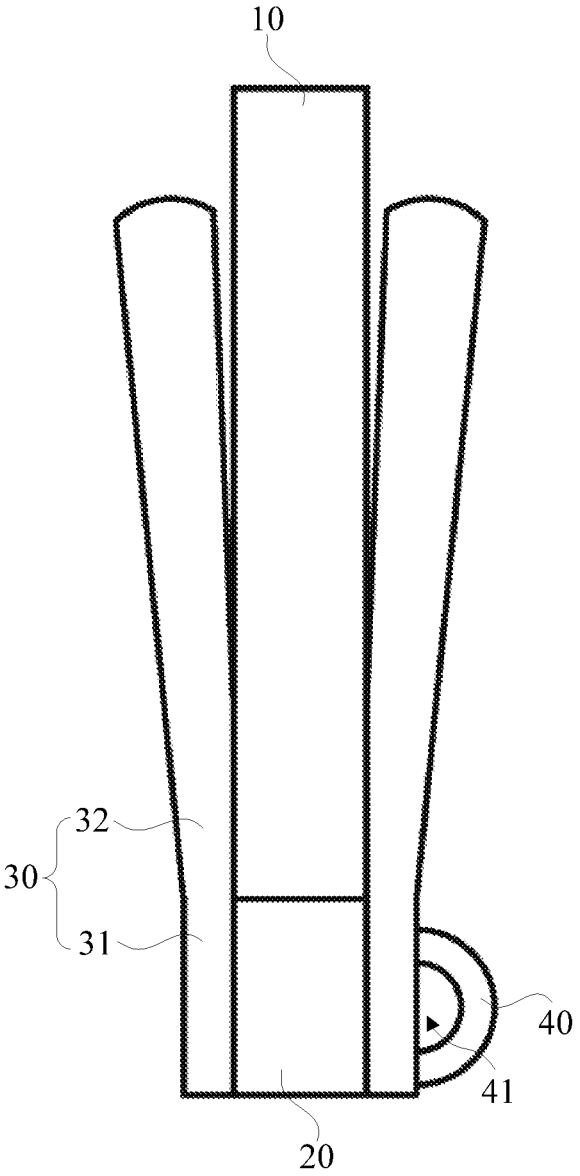
FIG. 2 is a side view 2 of the electronic cigarette according to an embodiment of the invention.

With continued reference to FIG. 1, the decorative part 30 includes a first part 31 and at least one second part 32, wherein the first part 31 sleeves the cigarette rod, and said at least one second part 32 is connected with the first part 31, and partially or fully encircles the cigarette rod 10 along the circumferential direction. The location of the first part 31 is not limited. In this embodiment, the first part 31 sleeves the portion which connects the cigarette cartridge 20 and the cigarette rod 10, and in other embodiments, the first part may sleeve other parts of the cigarette rod. Referring to FIG. 1, the first part 31 and the second part 32 of the decorative part 30 are split. Referring to FIG. 2, the first part 31 and the second part 32 of the decorative part 30 are integrally formed.

Figure 3:
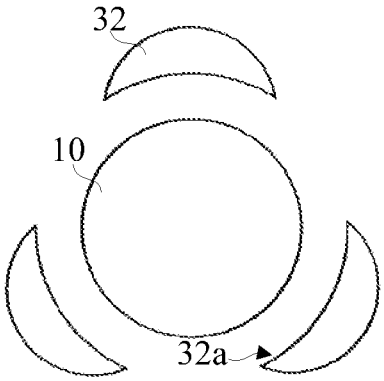
FIG. 3 is a top view 1 of the electronic cigarette according to an embodiment of the invention.
Figure 4:
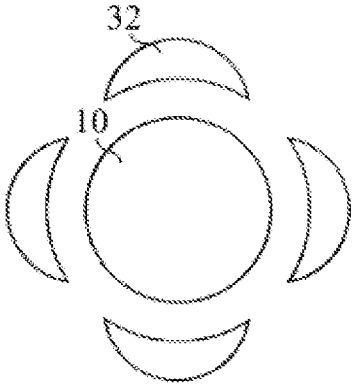
FIG. 4 is a top view 2 of the electronic cigarette according to an embodiment of the invention.

The number of the second part 32 of the decorative part 30 is not limited. In this embodiment, at least two second parts 32 are spaced equally along the circumferential direction of the cigarette rod 10. Three second parts 32 are shown in FIG. 3 and four second parts 32 are shown in FIG. 4. In other embodiments, other numbers of second parts may be provided. For example, the number of the second part 32 is one, and the second part is cylindrical, which fully encircles the cigarette rod along the circumferential direction.

The specific material of the decorative part 30 is not limited. For example, the first part 31 and the second part 32 may be made of light materials such as PMMA (poly(methyl methacrylate)), PP plastic, PA nylon, ABS and so on, which reduces the weight of the electronic cigarette and also improves the cushioning function of the decorative part 30. Alternatively, the first part 31 and the second part 32 are made of metal such as aluminum, zinc alloy, copper, stainless steel and so on, which may be formed by machining or metal casting.

With continued reference to FIG. 1, the extending direction of the second part 32 of the decorative part 30 (shown in the Y direction in FIG. 1) is set at an angle with the extending direction of the cigarette rod 10 (shown in the X direction in FIG. 1). When a plurality of second parts 32 encircles the cigarette rod 10 along the circumferential direction, the end of the cigarette rod 10 of the entire electronic cigarette is petal-shaped, and the electronic cigarette looks beautiful. At the same time, when the electronic cigarette slides off to the ground, the end of the second part 32 of the decorative part 30 that is not connected to the first part 31 will first make contact with the ground. Eventually, the cigarette rod 10 supported by the decorative part 30 will not make contact with the ground, which can protect the cigarette rod 10 better.

Figure 5:
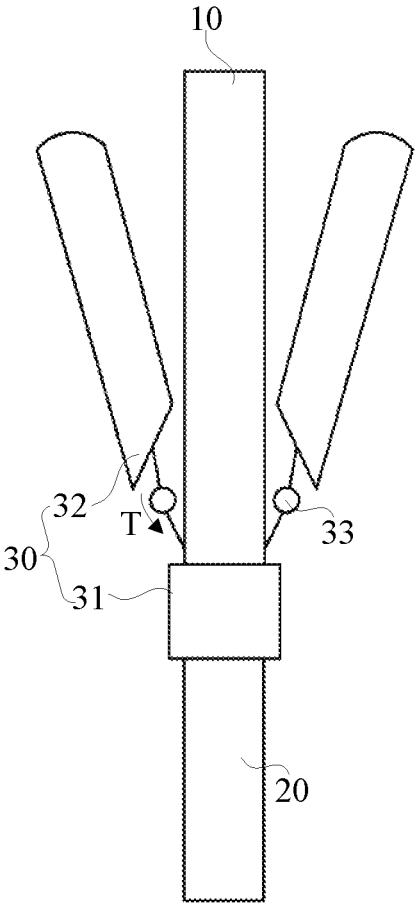
FIG. 5 is a side view 3 of the electronic cigarette according to an embodiment of the invention.

Referring to FIG. 5, in this embodiment, the second part 32 and the first part 31 of the decorative part 30 are rotatably connected. The second part 32 rotates with respect to the first part 31 when subjected to an external force so said angle changes, and stand still with respect to the first part 31 without external force. That is, the angle between the second part 32 and the cigarette rod 10 can be changed by rotating the second part 32 of the decorative part 30, and the angle ranges from 0 degree to 180 degrees, including 0 degree and 180 degrees. Different users can rotate the second part 32 to change the angle between the second part 32 and the cigarette rod 10 according to their own needs, and thus the user experience is good. At the same time, the users can also hold the first part 31 or the second part 32 of the decorative part 30 to avoid holding the portion of the electronic cigarette that has excessive heat. That is, the decorative part 30 plays a role of heat insulation, so that users have a good experience during suctioning.

Specifically, referring to FIG. 5, in this embodiment, the second part 32 is rotatably connected to the first part 31 through a rotating shaft 33, and the axial direction of the rotating shaft 33 is orthogonal to the extending direction of the cigarette rod 10. The "orthogonal" is that the axial direction of the rotating shaft 33 and the extending direction of the cigarette rod 10 are perpendicular but non-intersecting in the three-dimensional space. In this way, the second part 32 can rotate around the rotating shaft 33 in the first direction (shown in the direction T in FIG. 5) to increase the angle between the second part 32 and the cigarette rod 10, or rotate around the rotating shaft 33 in the second direction (the direction opposite to the direction T in FIG. 5) opposite to the first direction to decrease the angle between the second part 32 and the cigarette rod 10.

In this embodiment, the rotating shaft 33 is a damping shaft. In other embodiments, it may be other types of rotating shafts, as long as the following conditions are met: the second part 32 rotates with respect to the first part 31 when subjected to an external force so said angle changes, and stand still with respect to the first part without external force.

Figure 6:
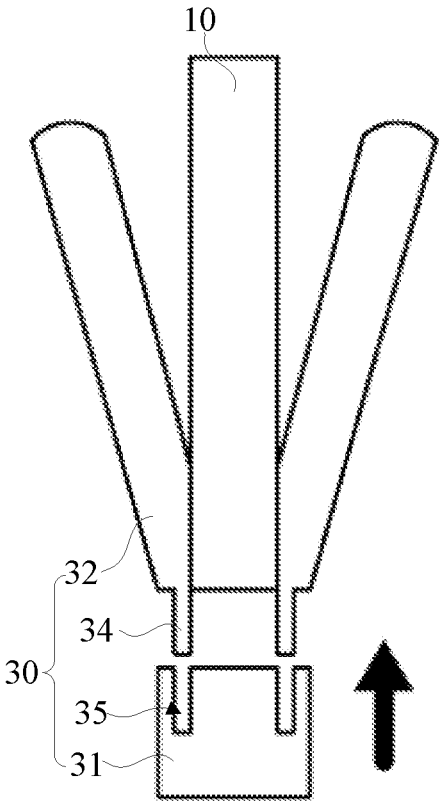
FIG. 6 is a schematic diagram 1 of the connection between the decorative part and the cigarette rod according to an embodiment of the invention in which the black arrow represents the separation direction of the first part and the second part.

It should be noted that the specific way of connecting the first part 31 and the cigarette rod 10 is not limited, and the specific way of connecting the second part 32 and the first part 31 is not limited, as long as they are connected and not separated from each other. Referring to FIG. 6, in this embodiment, the first part 31 is clamped with the cigarette rod 10 and the second part 32 is clamped with the first part 31. The specific implementation form of clamping is not limited. For example, referring to FIG. 6, the second part 32 has an insertion part 34, and the first part 31 has a slot 35. The first part 31 will be clamped with the second part 32 after the insertion part 34 is inserted into the slot 35. In other embodiments, the first part may have an insertion part and the second part may have a slot.

Figure 7:
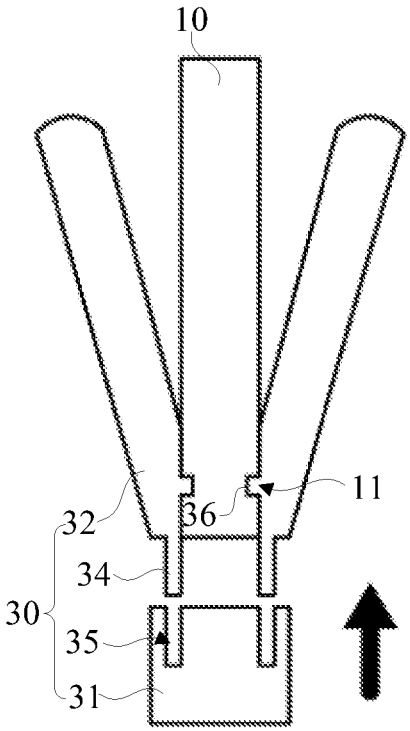
FIG. 7 is a schematic diagram 2 of the connection between the decorative part and the cigarette rod according to an embodiment of the invention in which the black arrow represents the separation direction of the first part and the second part.

In addition, in this embodiment, each of the second part 32 is split, and each of them is connected to the cigarette rod 10 by means of bonding and then is clamped with the first part 31 whereby the second part 32 is locked on the cigarette rod 10. In other embodiments, the second part 32 may be connected to the smoking rod 10 in other ways. For example, referring to FIG. 7, the second part 32 is connected to the cigarette rod 10 by clamping. The portion of the second part 32 facing the cigarette rod 10 is provided with a clamping block 36, and the cigarette rod 10 is provided with a slot 11, and the clamping block 36 of the second part 32 is clamped with the slot 11 of the cigarette rod 10. When each second part 32 is integrally formed, the second part 32 can be screwed with the cigarette rod 10.

In addition, at least one second part 32 is provided with a light source, and the second part 32 is electrically connected to the first part 31 that is electrically connected to the cigarette rod 10. After the electronic cigarette is turned on, the light source on the second part 32 will brighten, so that on the one hand the electronic cigarette becomes beautiful, and on the other hand users can find the electronic cigarette they smoke in the darkness through the light source after the electronic cigarette slides off to the ground, which improves the user experience.

Specifically, the cigarette rod 10 is provided with a power supply (not shown) and a power switch (not shown) that triggers the electrical connection between the power supply in the cigarette rod 10 and the first part 31. Users operate the power switch when smoking the electronic cigarette in the darkness, so that the power supply in the cigarette rod 10 and the first part 31 are electrically connected. The power supply provides electricity to the second part 32 that is electrically connected to the first part 31, so that the light source emits light.

In other embodiments, the cigarette rod is provided inside with a power supply and a gas path sensor, wherein the gas path sensor controls the power supply to provide electricity to the cigarette cartridge when detecting that the aerosol channel in the cigarette cartridge is in a circulating state, and the power supply and the first part are electrically connected. When users smoke the electronic cigarette, the circuit of the electronic cigarette is turned on, and the power supply provides electricity to the cigarette cartridge, so that the power supply and the first part are electrically connected. The power supply provides electricity to the second part that is electrically connected to the first part, so that the light source emits light.

Figure 8:
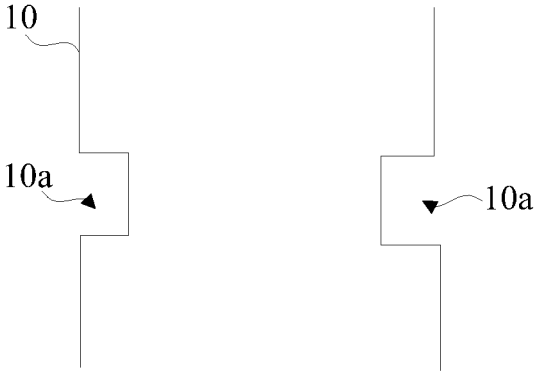
FIG. 8 is a side view of the cigarette rod according to an embodiment of the invention which shows a partial structure of the cigarette rod.

In addition, the cigarette rod 10 is further provided with cigarette rod PCB (not shown), on which the power supply is provided. Referring to FIG. 8, the portion of the cigarette rod 10 facing the first part 31 is provided with through holes 10*a* for exposing the positive contact and the negative contact on the cigarette rod PCB; referring to FIG. 9, positive pin 31*a* and negative pin 31*b* on the first part 31 are respectively inserted into each through hole 10*a* to achieve an electrical connection with the cigarette rod PCB.

Figure 9:
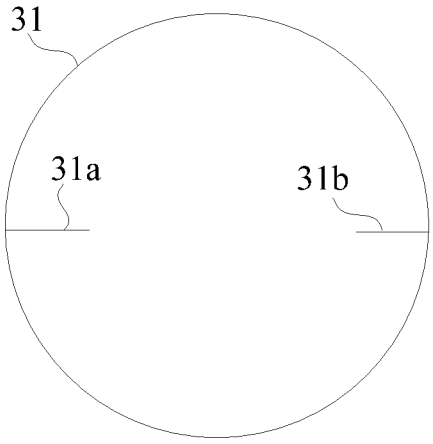
FIG. 9 is a top view of the first part of the decorative part according to an embodiment of the invention.

In this embodiment, referring to FIG. 9, the positive pin 31*a* and the negative pin 31*b* are provided on the inner cavity wall of the first part 31, and can move toward or away from the inner cavity wall in a radial direction that is perpendicular to the direction of the extension of the cigarette rod 10. That is, the positive pin 31*a* and the negative pin 31*b* of the inner cavity wall of the first part 31 are retractable. When the first part 31 is not attached to the cigarette rod 10, the positive pin 31*a* and the negative pin 31*b* are in a stationary state.

In the process of sleeving the first part 31 on the cigarette rod 10, when the cigarette rod 10 contacts with the positive pin 31*a* and the negative pin 31*b*, the positive pin 31*a* and the negative pin 31*b* are compressed to move toward the inner cavity of the first part 31, and the cigarette rod 10 is smoothly inserted into the first part 31. When the first part 31 moves to where the positive pin 31*a* and the negative pin 31*b* are opposed to the through holes 10*a* on the cigarette rod 10, the positive pin 31*a* and the negative pin 31*b* move away from the inner cavity wall in a radial direction, and the positive pin 31*a* and the negative pin 31*b* are respectively inserted into each through hole 10*a* to achieve an electrical connection with the cigarette rod PCB.

It should be noted that the positions of the positive pin 31*a* and the negative pin 31*b* on the inner cavity wall of the first part 31 are not limited. In this embodiment, referring to FIG. 9, the positive pin 31*a* and the negative pin 31*b* are arranged oppositely along the radial direction.

Figure 10:
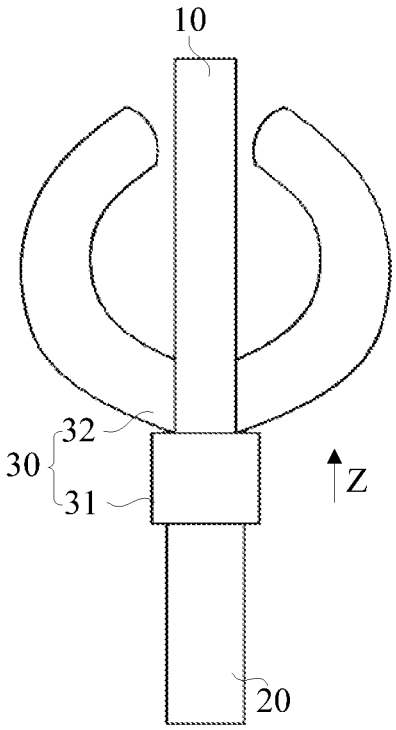
FIG. 10 is a side view 4 of the electronic cigarette according to an embodiment of the invention.
Figure 11:
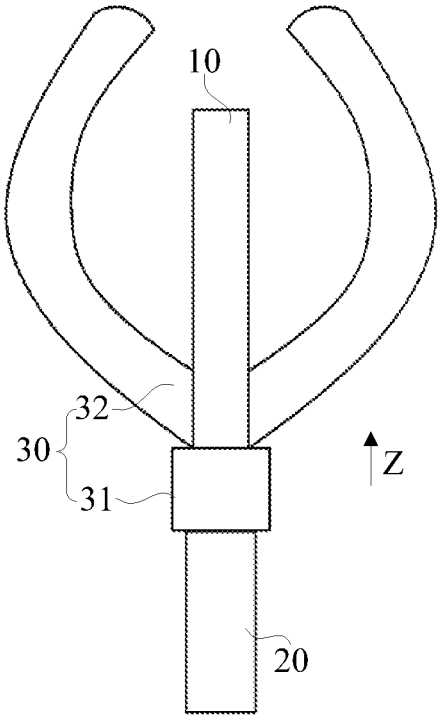
FIG. 11 is a side view 5 of the electronic cigarette according to an embodiment of the invention.

In addition, the property of the second part 32 is not limited. With reference to FIG. 1 and FIG. 2, the second part 32 is in a shape of a straight bar. With reference to FIG. 10 and FIG. 11, the second part 32 is in a shape of a curve. It should be noted that "the shape of a non-straight bar" can be understood as "the shape of a curve". For example, the shape of a curve shown in FIG. 10 and FIG. 11 is semicircle, and in other embodiments, the shape of a curve may be a shape of "S".

With continued reference to FIG. 10, the cigarette rod 10 is longer than the second part 32 in the direction from the cigarette cartridge 20 toward the cigarette rod 10 (shown in the Z direction in FIG. 10). Or referring to FIG. 11, the second part 32 is longer than the cigarette rod 10 in the direction from the cigarette cartridge 20 toward the cigarette rod 10 (shown in the Z direction in FIG. 11). Under these designs, the second part 32 completely wraps the cigarette rod 10, further protecting the cigarette rod 10.

With continued reference to FIG. 3, the portion of each second part 32 facing the cigarette rod 10 is a concave portion 32*a* which extends along the extending direction of the second part 32. The concave portion 32*a* is designed to reduce the weight of the electronic cigarette and make the electronic cigarette look beautiful. In other embodiments, the portions of other numbers of the second parts 32 facing the cigarette rod 10 may be concave portions 32*a* which extend along the extending direction of the second part 32.

With continued reference to FIG. 1 and FIG. 2, the first part 31 is provided with at least one convex portion 40 on its outer surface. The shape of the convex portion 40 is not limited. In this embodiment, the convex portion 40 is arc-shaped and has a perforation 41. In other embodiments, the convex portion 40 is in a hook shape. In this way, a pendant can be provided on the convex portion 40, increasing the added value of the electronic cigarette.

In summary, the above-mentioned embodiments provided are only illustrative of the principle and efficacy of the invention, and are not intended to limit the invention. Anyone familiar with this technology can modify or change the above embodiments without departing from the spirit and scope of the invention. Therefore, all equivalent modifications or changes made by those with ordinary knowledge in the technical field without departing from the spirit and technical ideas disclosed in the invention should still be covered by the claims of the invention.

The invention claimed is:

1. An electronic cigarette, comprising:

a cigarette cartridge;

a cigarette rod, which is connected to the cigarette cartridge and provides electricity to the cigarette cartridge; and at least one decorative part partially or fully encircling the cigarette rod along the circumferential direction, wherein the decorative part includes a first part that sleeves the cigarette rod and at least one second part connected with the first part that partially or fully encircles the cigarette rod along the circumferential direction, and wherein an extending direction of the at least one second part is set at an angle to an extending direction of the cigarette rod, wherein the second part and the first part are rotatably connected; the second part rotates with respect to the first part when subjected to an external force so said angle changes, and stand still with respect to the first part without external force.

2. The electronic cigarette according to claim 1, wherein the first part and the second part are formed in integrity.

3. The electronic cigarette according to claim 1, wherein the first part is clamped with the cigarette rod, and the second part is clamped with the first part.

4. The electronic cigarette according to claim 1, wherein said at least one second part is provided with a light source, and the second part is electrically connected to the first part that is electrically connected to the cigarette rod.

5. The electronic cigarette according to claim 4, wherein the cigarette rod is provided with a power supply and a power switch that triggers the electrical connection between the power supply and the first part.

6. The electronic cigarette according to claim 4, wherein the cigarette rod is provided inside with a power supply and a gas path sensor, wherein the gas path sensor controls the power supply to provide electricity to the cigarette cartridge when detecting that an aerosol channel in the cigarette cartridge is in a circulating state, and the power supply and the first part are electrically connected.

7. The electronic cigarette according to claim 6, wherein the cigarette rod is further provided with cigarette rod printed circuit board (PCB), on which the power supply is provided, wherein the portion of the cigarette rod facing the first part is provided with through holes for exposing a positive contact and a negative contact on the cigarette rod PCB;

the first part is provided with positive pin and negative pin that are respectively inserted into each through hole to achieve an electrical connection with the cigarette rod PCB.

8. The electronic cigarette according to claim 7, wherein the positive pin and the negative pin are provided on an inner cavity wall of the first part, and can move toward or away from the inner cavity wall in a radial direction that is perpendicular to the direction of the extension of the cigarette rod.

9. The electronic cigarette according to claim 7, wherein the positive pin and the negative pin are arranged oppositely along the radial direction.

10. The electronic cigarette according to claim 1, wherein at least two second parts that are spaced equally along the circumferential direction.

11. The electronic cigarette according to claim 1, wherein the angle ranges from 0 degree to 180 degrees.

12. The electronic cigarette according to claim 1, wherein the second part is rotatably connected to the first part through a rotating shaft, and the axial direction of the rotating shaft is orthogonal to the extending direction of the cigarette rod.

13. The electronic cigarette according to claim 12, wherein the rotating shaft is a damping shaft.

14. The electronic cigarette according to claim 1, wherein the second part is in a shape of a straight bar or a curve.

15. The electronic cigarette according to claim 1, wherein the cigarette rod is longer than the second part, or the second part is longer than the cigarette rod in the direction from the cigarette cartridge toward the cigarette rod.

16. The electronic cigarette according to claim 1, wherein the portion of at least one of the second part facing the cigarette rod is a concave portion which extends along the extending direction of the second part.

17. The electronic cigarette according to claim 1, wherein the first part is provided with at least one convex portion on its outer surface, the convex portion having a perforation or being in a hook shape.

18. The electronic cigarette according to claim 17, wherein the convex portion is arc-shaped.

* * * * *